US006831617B1

(12) United States Patent
Miyauchi et al.

(10) Patent No.: US 6,831,617 B1
(45) Date of Patent: Dec. 14, 2004

(54) DISPLAY UNIT AND PORTABLE INFORMATION TERMINAL

(75) Inventors: Motoya Miyauchi, Tokyo (JP); Yutaka Machida, Yokohama (JP); Tadashi Kayada, Yokohama (JP); Kosuke Kubota, Yokosuka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 420 days.

(21) Appl. No.: 09/708,840

(22) Filed: Nov. 8, 2000

(30) Foreign Application Priority Data

Nov. 9, 1999 (JP) ..... P.11-318459
Nov. 2, 2000 (JP) ..... P.2000-336067

(51) Int. Cl.[7] ..... G09G 3/04

(52) U.S. Cl. ..... 345/33; 345/38; 345/51; 345/1.3; 345/103

(58) Field of Search ..... 345/33, 38, 51, 345/63, 77, 761, 205, 1.3, 903, 103

(56) References Cited

U.S. PATENT DOCUMENTS

| | | | | |
|---|---|---|---|---|
| 4,378,557 A | | 3/1983 | Murata | |
| 5,028,917 A | * | 7/1991 | Imanishi et al. | 345/690 |
| 5,481,431 A | | 1/1996 | Siahpolo et al. | |
| 5,703,616 A | * | 12/1997 | Kawasugi | 345/98 |
| 5,784,035 A | * | 7/1998 | Hagiwara et al. | 345/1.3 |
| 5,796,391 A | * | 8/1998 | Chiu et al. | 345/204 |
| 5,867,140 A | * | 2/1999 | Rader | 345/98 |
| 5,881,299 A | * | 3/1999 | Nomura et al. | 713/324 |
| 6,292,157 B1 | * | 9/2001 | Greene et al. | 345/1.3 |

FOREIGN PATENT DOCUMENTS

| | | |
|---|---|---|
| EP | 0 651 367 A1 | 5/1995 |
| EP | 0 655 725 A1 | 5/1995 |
| EP | 0 678 987 A1 | 10/1995 |
| EP | 0 811 866 A1 | 12/1997 |
| EP | 0 852 371 A1 | 8/1998 |
| JP | 06095621 | 4/1994 |
| JP | 10054971 | 2/1998 |

* cited by examiner

*Primary Examiner*—Matthew C. Bella
*Assistant Examiner*—Antonio A. Caschera
(74) *Attorney, Agent, or Firm*—Pearne & Gordon LLP

(57) ABSTRACT

A control section 130 for outputting a selection signal for selecting the display areas of the display section 110 and transferring display data classified in response to the display areas and the display type to both or either of a display data processing section A 140 and a display data processing section B 133, the display data processing section A 140 and the display data processing section B 133 for converting the display data into a format fitted for the display area and the display type, a data transfer path 160 for separately transferring data from the display data processing section A 140 to the display section 110, and a data transfer path 170 for separately transferring data from the display data processing section B 133 to the display section 110, wherein images of the display data generated by the display data processing section A 140 and the display data processing section B 133 of the display section 110 are selectively displayed in the display area of the display section 110 based on the selection signal of the control section.

21 Claims, 4 Drawing Sheets

DISPLAY UNIT AND PORTABLE INFORMATION TERMINAL

BACKGROUND OF THE INVENTION

1. Field of the Invention

This invention relates to a display unit having a plurality of display areas and a portable information terminal installing the display unit.

2. Description of the Related Art

In recent years, a display unit installed in a portable information terminal such as a portable telephone terminal has been ready for color display and further ready for moving image display. To support color display, power consumption is increased as compared with the current monochrome display and to support moving image display, moving image decoding newly becomes necessary and thus power consumption is increased as compared with the current still image or text display.

On the other hand, longer time is required as the standby time and the conversation time although the battery capacity has a decrease tendency with miniaturization of a portable telephone terminal.

To attempt to produce color display or display a moving image according to a display method in a related art, power consumption grows as compared with the current monochrome display and still image display. Thus, it is possible that an image is displayed only at the conversion time and operation time without displaying any image in the standby mode, thereby ensuring the standby time. However, for example, battery display, received electric field strength display, and the like need always be produced even in the standby mode, thus it is impossible to display no images in the standby mode.

SUMMARY OF THE INVENTION

It is therefore an object of the invention to provide a display unit and a portable information terminal capable of displaying a color image and a moving image while suppressing power consumption.

The display unit according to this invention comprises a display section that can be divided into a plurality of display areas, a power supply section that can selectively supply power to the plurality of display areas of the display section, a control section for outputting a selection signal for selecting the display areas of the display section and transferring display data classified in response to the display areas, a plurality of display data processing sections for converting the display data into a format fitted for the display area, and a data transfer path for separately transferring data from each of the display data processing sections to the display section, wherein an image of the display data generated by the display data processing section is selectively displayed in the display area of the display section based on the selection signal of the control section, so that power can be selectively supplied to the display areas of the display section in response to the display state, whereby power consumption can be suppressed.

According to the display unit of this invention, the display section is switched at least between a partial display area and a full display area containing the partial display area, so that the display area can be switched, whereby power consumption can be suppressed.

According to the display unit of this invention, the images of display data generated by the different display data processing sections are displayed in the plural display areas, and images in different formats can be displayed in the display areas based on the image data of interface specifications corresponding to each display area.

According to the display unit of this invention, display data is transferred on a slow data transfer period from the display data processing section to the display section for displaying an image in the partial display area and display data is transferred on a fast data transfer period from the display data processing section to the display section for displaying an image in the full display area or any display area other than the partial display area, so that the data transfer rate from the display data processing section to the display section can be changed in response to the display area, whereby power consumption can be suppressed.

According to the display unit of this invention, the data transfer path has signal lines a different number of which are assigned to the plural display areas, the display data is transferred via the signal lines, the number of signal lines can be defined in response to the display area, and the number of signal lines for transferring data to the display section can be reduced.

According to the display unit of this invention, a low frame frequency image is displayed in the first display area, a high frame frequency image is displayed in the full display area or any display area other than the partial display area, and the frame frequency can be changed in response to the display area, whereby power consumption can be suppressed.

According to the display unit of this invention, a low-gradation image is displayed in the first display area, a high-gradation image is displayed in the full display area or any display area other than the partial display area, and the gradation can be changed in response to the display area, whereby power consumption can be suppressed.

According to the display unit of this invention, display data is transferred on different data transfer periods in order from the display data processing section to the display section for displaying images in the full display area, so that the transfer period of the image data to be displayed can be changed whenever necessary, whereby power consumption can be suppressed.

According to the display unit of this invention, images different in frame frequency are displayed in order in the full display area, so that the frame frequency of the image to be displayed can be changed whenever necessary, whereby power consumption can be suppressed.

According to the display unit according to the invention, images different in gradation are displayed in order in the full display area, so that the gradation of the image to be displayed can be changed whenever necessary, whereby power consumption can be suppressed.

The display unit of this invention comprises a display section that can be divided into a plurality of display areas, a power supply section for selectively supplying power to the plurality of display areas of the display section, a control section for outputting a selection signal for arbitrarily specifying the display areas of the display section and transferring display data classified in response to the display areas, a plurality of display data processing sections corresponding to the specified image areas for defining at least one of data transfer period, frame frequency, and gradation of the display data corresponding to the specified image areas, and a data transfer path for separately transferring data from each of the display data processing sections to the display section, wherein images different in at least one of data transfer period, frame frequency, and gradation of the display data are displayed in the display areas of the display section based on the display data controlled in the display data processing sections, and the images different in format can be displayed in a plurality of display areas, whereby power consumption can be suppressed.

According to the display unit of this invention, the power supply section can supply different drive voltages to the display areas specified by the control section, so that the drive voltage of the display section can be changed partially, whereby power consumption can be suppressed.

According to the display unit of this invention, the control section specifies display or non-display for each of the display areas of the display section and the power supply section supplies power only to the area whose display is specified by the control section, so that power supply can be shut off partially, whereby power consumption can be suppressed.

According to the portable information terminal of this invention, an image is displayed in the first display area in the standby mode and an image is displayed in a full display area at the use time and the display area can be changed in the standby mode and at the use time, whereby power consumption can be suppressed.

According to the portable information terminal of this invention, display data is transferred on a slow data transfer period from the display data processing section to the display section for displaying an image in the full display area in the standby mode and display data is transferred on a fast data transfer period from the display data processing section to the display section for displaying an image in the full display area at the use time, so that the data transfer period can be changed in the standby mode and at the use time, whereby power consumption can be suppressed.

According to the portable information terminal of this invention, a low frame frequency image is displayed in the full display area in the standby mode and a high frame frequency image is displayed in the full display area at the use time, so that the frame frequency of an image can be changed in the standby mode and at the use time, whereby power consumption can be suppressed.

According to the portable information terminal of this invention, a low-gradation image is displayed in the full display area in a standby mode and a high-gradation image is displayed in the full display area at the use time, so that the gradation of an image can be changed in the standby mode and at the use time, whereby power consumption can be suppressed.

According to the portable information terminal of this invention, at least one of slow data transfer period, low frame frequency, and low gradation is set in a standby mode and at least one of fast data transfer period, high frame frequency, and high gradation is set at the use time and display data is transferred via as many signal lines as the number of signal lines complying with the corresponding data transfer format from the corresponding display data processing section to the display area, so that the data transfer period, the frame frequency, and/or the gradation of an image can be controlled in the standby mode and at the use time, whereby power consumption can be suppressed.

DESCRIPTION OF THE PREFERRED EMBODIMENTS

Referring now to the accompanying drawings, there are shown preferred embodiments of the invention.

Figure 1:
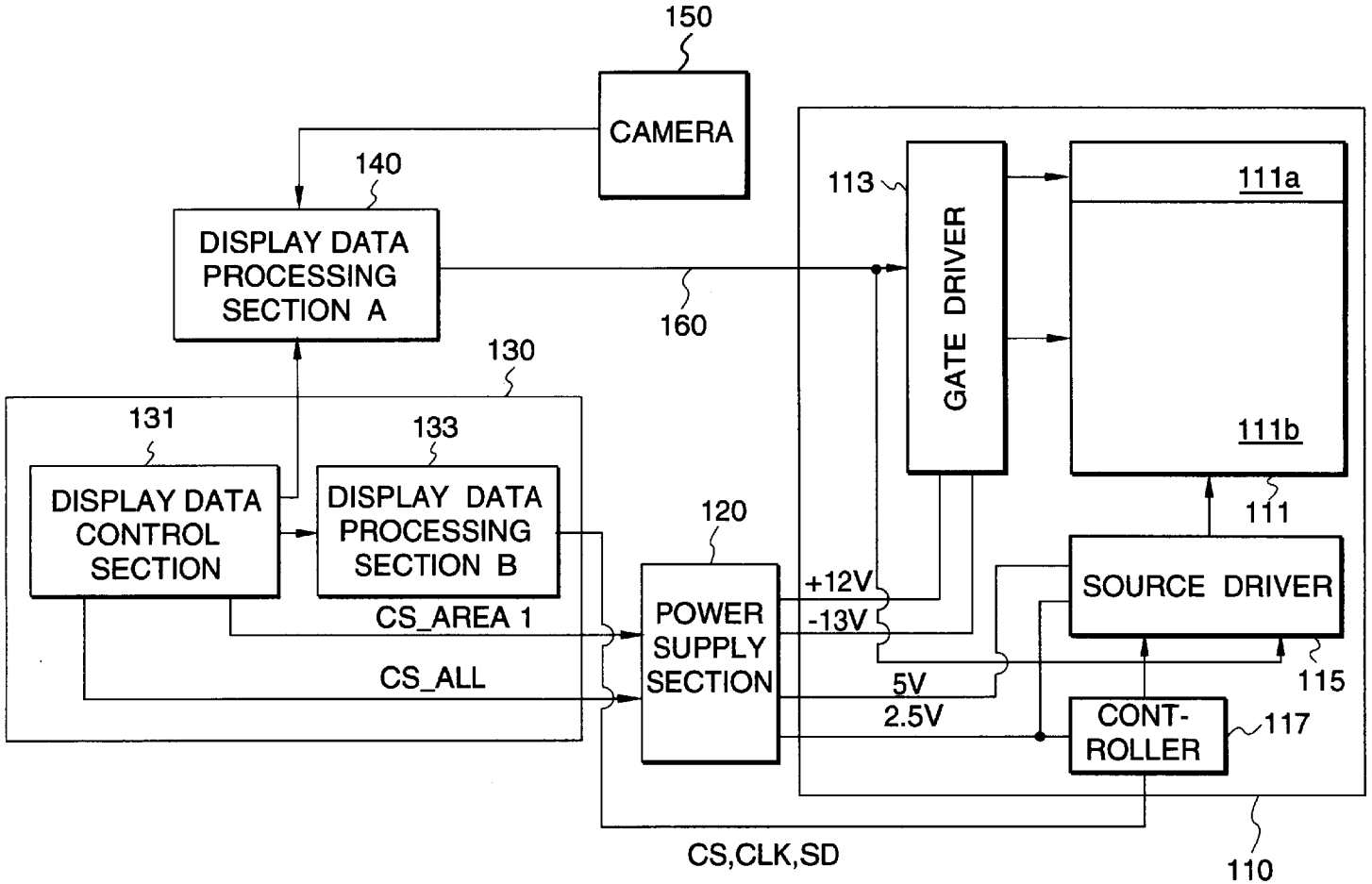
FIG. 1 is a block diagram to show one embodiment of the invention.
Figure 2:
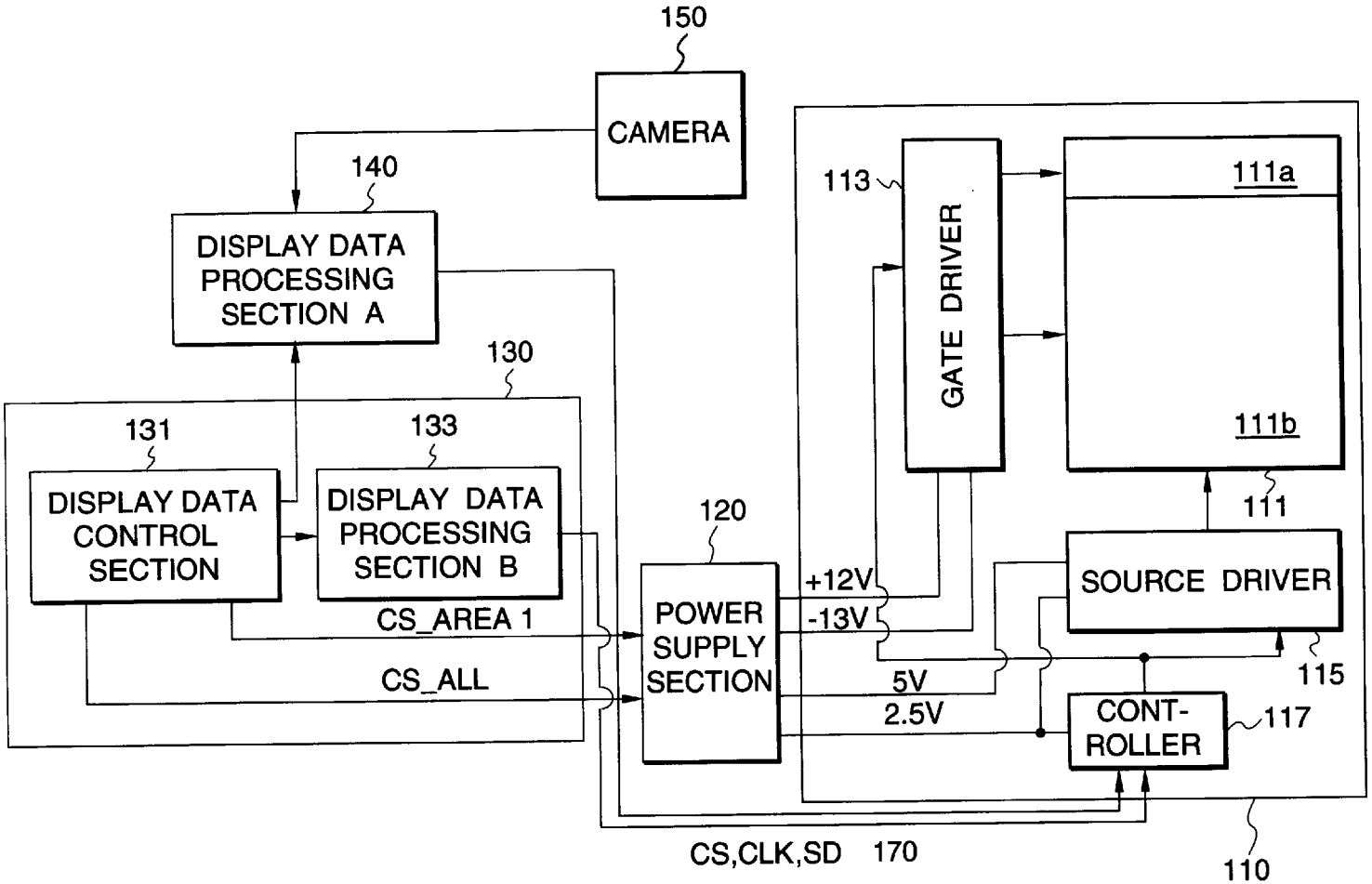
FIG. 2 is a block diagram to show another embodiment of the invention.
Figure 3:
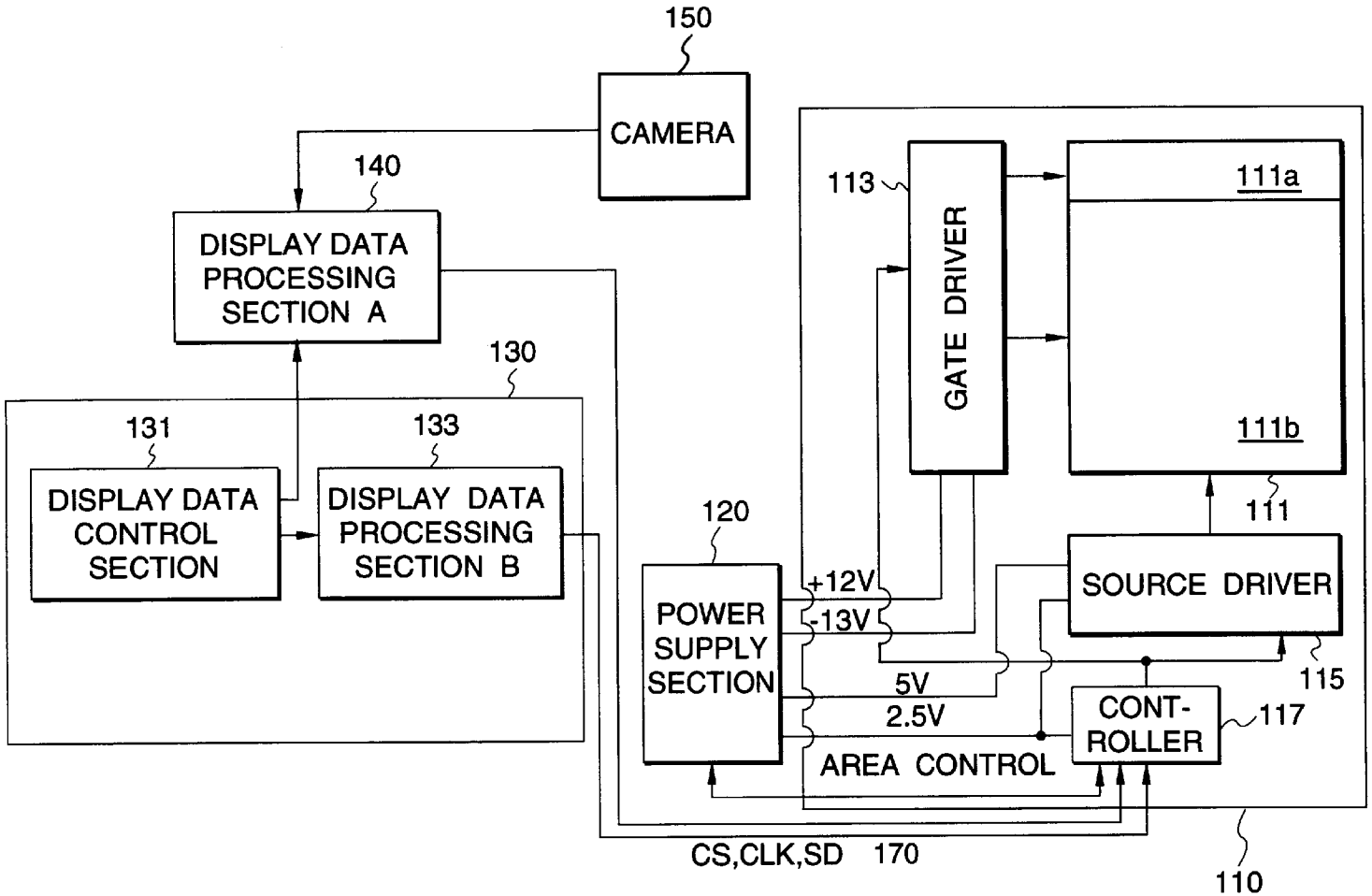
FIG. 3 is a block diagram to show further embodiment of the invention.

FIG. 1 shows one embodiment of a display unit of the invention. As shown in FIG. 1, a display unit comprises a liquid crystal display section 111 of TFT (thin-film transistor) type divided into a first display area 111*a* and a second display area 111*b*, a gate driver 113 and a source driver 115 for driving the liquid crystal display section 111, a controller 117 containing memory for supplying serial display data to the source driver 115, a power supply section 120 for supplying power to the gate driver 113, the source driver 115, and the controller 117, a control section 130 into which a display data control section 131 for classifying display data to display on the liquid crystal display section 111 and a font generation section 133, one of display data processing sections, are integrated, and a display data processing section 140 for converting the display data classified by the control section 130 into a format fitted for liquid crystal display. The display data may be supplied from the controller 117 containing the memory to the gate driver 113 and the source driver 115, as shown in FIG. 2, depending on the configuration contents. In this case, both display data from the display data processing section A 140 and display data from the display data processing section B 133 are supplied to the controller. Different configuration contents are also possible; as shown in FIG. 3, the controller 117 may control the power supply section 120. In this case, a command specifying the display area to a data signal from the display data processing section can be supplied to the controller 117. Further, in addition, image processing section may be integrated into the control section 130.

The liquid crystal display section 111, the gate driver 113, the source driver 115, and the controller 117 make up a display section 110. The liquid crystal display section 111 may be a liquid crystal display capable of producing color display, such as a liquid crystal display of TN (twist nematic) type, etc., as well as the TFT type; it may be a liquid crystal display incorporating EL (electroluminescent) or LED (light emitting diode) or a flat-panel type display unit of PDP (plasma display), etc., rather than a liquid crystal display.

The first display area 111*a* of the liquid crystal display section 111 is an area for displaying a monochrome still image and is statically driven to suppress power consumption. The first display area 111*a* is selected by the gate driver 113 in the standby mode and displays still images displayed at all times, such as a battery icon, a time icon, an out-of-range icon, a received electric field strength icon, and mail information registered in the terminal if the terminal is a portable telephone. The second display area 111*b* of the liquid crystal display section 111 is an area for displaying color images of about 260000 colors and undergoes active matrix drive. The second display area 111*b* is selected together with the first display area 111*a* by the gate driver 113 at the conversion time and the operation time (use time) and displays images displayed when required, such as a color pictograph registered in the terminal and an image distributed via a network.

The power supply section 120 supplies power of voltages shown in the figure to the gate driver 113, the source driver 115, and the controller 117 making up the display section 110. Further, the display data control section 131 supplies a selection signal for selecting the first display area 111*a* (CS_AREA1) and a selection signal for selecting the first and second display areas 111*a* and 111*b* (CS_ALL) to the power supply section 120 as selection signals for selecting the display areas of the liquid crystal display section 111. The selection signal of the display area may be input to the controller for controlling the power supply section (FIG. 2). In this case, a command is sent to the controller 117 with display area control signal as a part of data signal from the second display data processing section (font generation section) 133, and control signal is supplied from the controller 117 to the power supply section 120.

The control section 130 classifies input display data according to the display contents determined by the display data control section 131 contained in the control section 130 and selects the path for displaying a display image on the liquid crystal display section 111. It supplies moving image data, still image data having a large number of gradation steps, and display data requiring a short transfer time to the first display data processing section 140 for converting the data into a synchronous signal fitted for moving image display. The second display data processing section (font generation section) 133 contained in the control section 130 converts a simple moving image, a low-gradation still image, and icon data into a data format fitted for small-scaled display (for example, SD: Serial data) and supplies the serial data (SD) together with chip select (CS) and clock (CLK) to the memory in the controller 117 of the display section 110.

The first display data processing section 140 decodes display data compressed, for example, in MPEG4 and converts the data into synchronous data fitted for moving image display for liquid crystal display in R, G, and B each consisting of six bits; the second display data processing section (font generation section) 133 defines color (display/non-display) of provided font data in two bits capable of representing monochrome and converts the font data into display data. The first display data processing section 140 can also convert input display data from a camera 150 into RGB each of six bits and output the display data via a data transfer path 160 to the display section 110 according to an instruction of the display data control section 131. The first display data processing section 140 converts display data into liquid crystal display data and supplies the data to the gate driver 113 and the source driver 115 forming the parts of the display section 110, for example, as a total of 30 control signals containing six bits of each of R, G, and B. The data from the first display data processing section 140 may be supplied to the controller 117, as shown in FIG. 2. The display data from the first display data processing section 140 can also be retained in the memory in the controller 117 in response to the display state. On the other hand, the second display data processing section 133 converts data into liquid crystal data for a partial display area, transfers the data in series, and supplies to the controller 117 forming a part of the display section 110, for example, with a total of three control signals.

The operation in the configuration described above will be discussed by taking a portable telephone as an example.

In the configuration, in the standby mode, the partial display area of the first display area 111*a* of the liquid crystal display section 111 is selected for displaying a monochrome still image and at the conversation time or the operation time (use time), a color image of about 260000 colors is displayed in the full display area consisting of the first display area 111*a* and the second display area 111*b*. The display area 111*a* may be a full screen depending on setting of the display areas. Further, in full screen display, it is also possible to display a monochrome still image only in the display area 111*a* depending on the element configuration of the display section.

First, the case of displaying an image in the standby mode will be discussed. The control section 130 activates the selection signal (CS_AREA1) supplied to the power supply section 120, whereby the gate driver 113 selects the first display area 111*a* and supplies power thereto. In the case in FIG. 3, a partial display control signal is sent to the controller 117 as a part of a data signal from the second display data processing section (font generation section) 133 and control signal is supplied from the controller 117 to the power supply section 120.

Monochrome still image data output from the control section 130 is retained in the memory in the controller 117 forming a part of the display section 110. The monochrome still image data retained in the memory is controlled by the source driver 115 so that data is sent to the pixels corresponding to the addresses of the memory. To display the first display area, the data transfer period from the control section 130 to the display section 110 is delayed (for example, once a second) and the transfer period of data read from the controller from the source driver to the liquid crystal display section 111 (frame frequency) is lowered, whereby it is made possible to drive with low power consumption.

The images displayed in the standby mode are not limited to the above-mentioned monochrome still image and may be images consuming lower power or having a small data transfer amount as compared with a color moving image displayed at the conversation time or the operation time (use time). As such images, a monochrome still image, a color still image, a color image of eight colors, a simple moving image, a low frame frequency image, and the like can be named.

Next, the case of displaying an image at the conversation time or operation time (use time) will be discussed. The control section 130 activates the selection signal (CS_ALL) supplied to the power supply section 120, whereby the gate driver 113 makes it possible to drive both the first and second display areas 111*a* and 111*b*. In the case in FIG. 3, a full area display control signal is sent to the controller 117 as a part of a data signal from the second display data processing section (font generation section) 133 and control signal is supplied from the controller 117 to the power supply section 120.

Color moving image data output from the display data processing section 140 is supplied to the gate driver 113 and the source driver 115 of the display section 110. The color moving image data may be supplied to the controller 117 and supplied from the controller 117 to the gate driver 113 and the source driver 115, as shown in FIG. 2. The gate driver 113 supplies voltage complying with the display data to a gate electrode of the liquid crystal display section 111 and the source driver 115 supplies voltage complying with the display data to a source electrode of the liquid crystal display section 111. The gradation of the liquid crystal display section 111 is controlled by the source driver 115.

In the description of the operation, a monochrome still image is displayed in the first display area 111*a* partial display area) and a color still image is displayed in the first and second display areas 111*a* and 111*b* (full display area); however, any combination of the images displayed in the partial display area and the full display area may be adopted if power consumption required when the image is displayed in the first display area 111*a* (partial display area) is lower than that required when the image is displayed in the full display area or if the data transfer amount of the image displayed in the first display area 111*a* is lower than that of the image displayed in the full display area. Combinations of a monochrome still image and a color moving image, a color still image and a color moving image, a half color image and a full color image, a low frame frequency image and a high frame frequency image, and the like are possible the combinations of the images displayed in the partial display area and the full display area.

Figure 4:
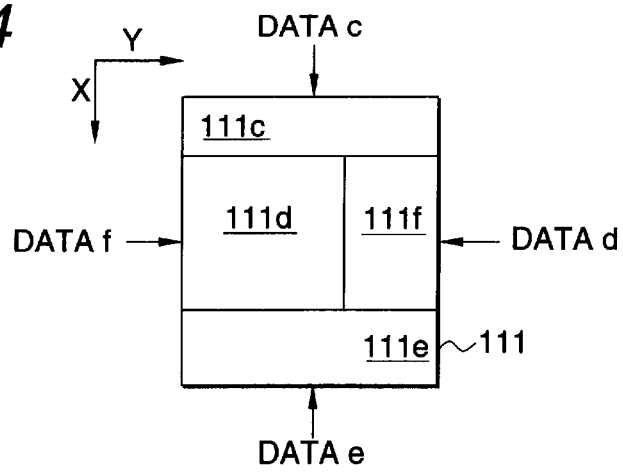
FIG. 4 is a drawing to show the display format of a liquid crystal display section 111 shown in FIG. 1.

The liquid crystal display section 111 is divided into two parts in the gate direction as shown in FIG. 1 and in addition, it may be divided in gate direction X to provide display areas 111*c* and 111*e* and divided in source direction Y to provide display areas 111*d* and 111*f*, as shown in FIG. 4. Display data pieces c, d, e, and f to display in the display areas are supplied. The division positions of the liquid crystal display section 111 are fixed and in addition, the division positions may be changed over time to vary the display areas.

Figure 5:
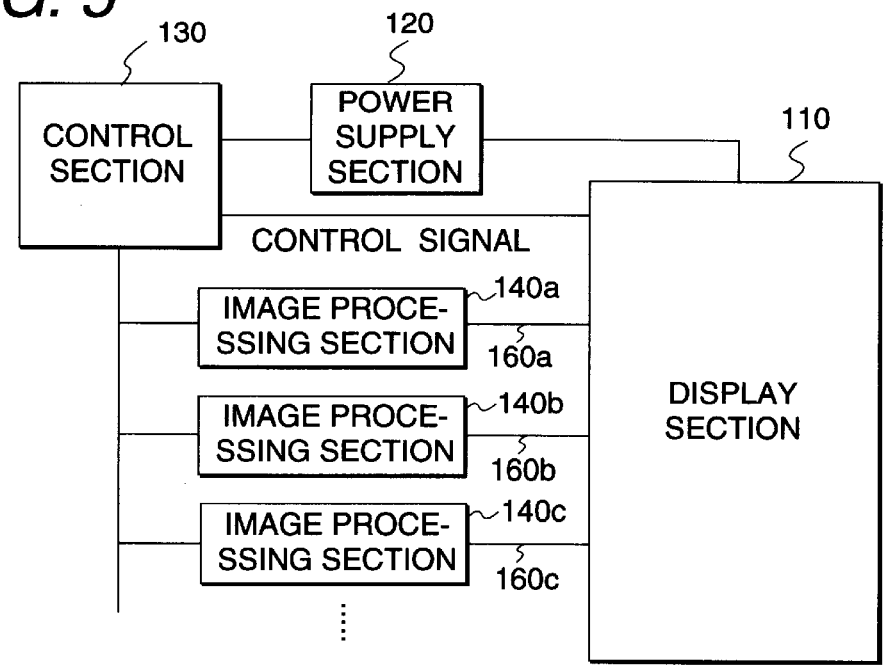
FIG. 5 is a drawing to show a display unit corresponding to a liquid crystal display section 111 shown in FIG. 4.

To display images in the display areas 111*c* to 111*f* as shown in FIG. 2, a plurality of display data processing sections 140 shown in FIG. 1 are provided for supplying display data to the display areas provided in a one-to-one correspondence with the display data processing sections (see FIG.5). In this case, the display data processing sections 140*a*, 140*b*, 140*c* . . . can transfer data to the display section on different transfer periods via a plurality of data transfer paths 160*a*, 160*b*, 160*c* . . . corresponding to the display areas of the display section in response to the control signal of the control section 130 and can generate display data different in frame frequency and/or gradation.

Further, the display areas may be driven on different power supply voltages and display data corresponding thereto may be generated.

Specification may be made so as to display only an arbitrary display area of the display areas and not to display other display areas. That is, the power supply section 120 supplies power only to the arbitrary display area of the display section 110 and does not supply power to any other display area based on an instruction from the control section 130.

Figure 6:
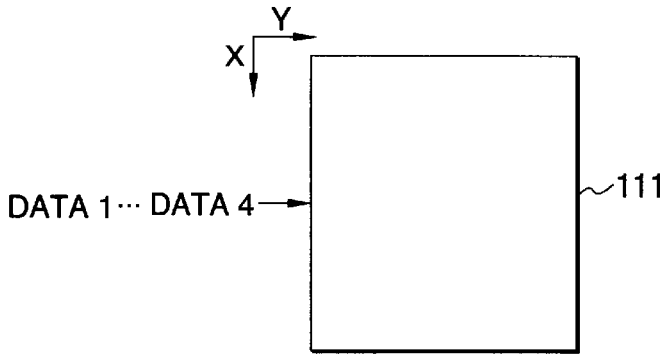
FIG. 6 is a drawing to show another display format of the liquid crystal display section 111 shown in FIG. 1.

Images different in format may be displayed on the whole liquid crystal display section 111 in order as shown in FIG. 6 without dividing the liquid crystal display section 111. In this case, as the display data supplied to the liquid crystal display section 111, if one display data processing section is provided (see FIG. 1), display data pieces 1 to 4 different in format are time-division multiplexed; if a plurality of display data processing sections are provided (see FIG. 5), they generate different display data pieces 1 to 4 in order.

Further, the first display area 111*a* (partial display area) of the liquid crystal display section 111 and the first and second display areas 111*a* and 111*b* (full display area) (see FIG. 1) may be driven on different voltages. Likewise, the display areas 111*c* to 111*f* (see FIG. 4) may be driven on different voltages and the liquid crystal display section 111 (see FIG. 6) may be driven on different voltages in order. Thus, the drive voltage required in the standby mode can be lowered for suppressing power consumption.

In the embodiment described above, the portable telephone is taken as an example, but the invention is not limited to it and can also be applied to any other portable information terminal.

What is claimed is:

1. A display unit comprising:

a display section that can be divided into a plurality of display areas;

a power supply section that can selectively supply power to the plurality of display areas of said display section based on a selection signal;

a control section for outputting said selection signal to said power supply section for selecting the display areas of said display section and transferring display data classified by the control section in accordance with the display areas;

a plurality of display data processing sections for converting the display data into a format corresponding to the display area in which the display data will be displayed;

a plurality of data transfer paths for separately transferring data from each of said display data processing sections to said display section;

a plurality of display data paths for selectively transferring said display data to said plurality of display data processing sections, and display data path selecting means for performing a selection of said plurality of display data paths for said display data to be transferred to one of said plurality of display data processing sections respective thereof, wherein an image of the display data generated by said display data processing section is selectively displayed in the display area of said display section based on the selection signal of said control section, and further wherein said selection of said plurality of display data paths is determined based on at least one of a format and data volume of said display data classified in accordance with the display areas.

2. The display unit as claimed in claim 1 wherein said display section is switched at least between a partial display area and a full display area containing the partial display area.

3. The display unit as claimed in claim 2 wherein images of display data generated by said different display data processing sections are displayed in the partial display area and the full display area.

4. The display unit as claimed in claim 3 wherein display data is transferred on a slow data transfer period from said display data processing section to said display section for displaying an image in the partial display area and display data is transferred on a fast data transfer period from said display data processing section to said display section for displaying an image in the full display area or any display area other than the partial display area.

5. A portable information terminal comprising a display unit as claimed in any one of claims 2 to 4, characterized in that an image is displayed in the partial display area in a standby mode and an image is displayed in a full display area at the use time.

6. The display unit as claimed in claim 3 or 4 wherein said data transfer path has signal lines a different number of which are assigned to the first to third display areas and the display data is transferred via the signal lines.

7. The display unit as claimed in claim 3 or 4 wherein a low frame frequency image is displayed in the partial display area and a high frame frequency image is displayed in the full display area or any display area other than the partial display area.

8. The display unit as claimed in claim 3 or 4 wherein a low-gradation image is displayed in the partial display area and a high-gradation image is displayed in the full display area or any display area other than the partial display area.

9. The display unit as claimed in claim 3 wherein display data is transferred on different data transfer periods in order from said display data processing section to said display section for displaying images in the full display area.

10. A portable information terminal comprising a display unit as claimed in claim 9, characterized in that display data is transferred on a slow data transfer period from said display data processing section to said display section for displaying an image in the full display area in a standby mode and display data is transferred on a fast data transfer period from said display data processing section to said display section for displaying an image in the full display area at the use time.

11. The display unit as claimed in claim 3 or 9 wherein images different in frame frequency are displayed in order in the full display area.

12. The display unit as claimed in claim 11 wherein images different in gradation are displayed in order in the full display area.

13. A portable information terminal comprising a display unit as claimed in claim 11, characterized in that a low frame frequency image is displayed in the full display area in a standby mode and a high frame frequency image is displayed in the full display area at the use time.

14. The display unit as claimed in claim 3, or 9 wherein images different in gradation are displayed in order in the full display area.

15. A portable information terminal comprising a display unit as claimed in claim 14, characterized in that a low-gradation image is displayed in the full display area in a standby mode and a high-gradation image is displayed in the full display area at the use time.

16. A display unit comprising:

a display section that can be divided into a plurality of display areas;

a power supply section for selectively supplying power to the plurality of display areas of said display section based on a selection signal;

a control section for outputting said selection signal to said power supply section for arbitrarily specifying the display areas of said display section and transferring display data classified in accordance with the display areas;

a plurality of display data processing sections corresponding to the specified image areas for defining at least one of data transfer period, frame frequency, and gradation of the display data corresponding to the specified image areas;

a plurality of data transfer paths for separately transferring data from each of said display data processing sections to said display section;

a plurality of display data paths for selectively transferring said display data to said plurality of display data processing sections; and display data path selecting means for performing a selection of said plurality of display data paths for said display data to be transferred to one of said plurality of display data processing sections respective thereof, wherein images different in at least one of data transfer period, frame frequency, and gradation of the display data are displayed in the display areas of said display section based on the display data controlled in said display data processing sections, and further wherein said selection of said plurality of display data paths is determined based on at least one of a format and data volume of said display data classified in accordance with the display areas.

17. The display unit as claimed in claim 16 wherein said power supply section can supply different drive voltages to the display areas specified by said control section and wherein said control section generates display data corresponding to the different drive voltages.

18. The display unit as claimed in claim 17 wherein said control section specifies display or non-display for each of the display areas of said display section and wherein said power supply section supplies power only to the area whose display is specified by said control section.

19. A portable information terminal comprising a display unit as claimed in claim 16 or 18, characterized in that at least one of slow data transfer period, low frame frequency, and low gradation is set in a standby mode and at least one of fast data transfer period, high frame frequency, and high gradation is set at the use time and display data is transferred via as many signal lines as the number of signal lines complying with the corresponding data transfer format from said corresponding display data processing section to the display area.

20. A portable information terminal comprising a display unit as claimed in claim 16 or 18.

21. A display unit comprising:

a display section that can be divided into a plurality of display areas;

a power supply section that can selectively supply power to the plurality of display areas of said display section;

a control section for outputting a selection signal to said power supply section for selecting the display areas of said display section and transferring display data classified by the control section in accordance with the display areas;

a first display data processing section for converting display data for high-power consuming images into a synchronous signal to be displayed on one of the plurality of display areas;

a second display data processing section for converting display data for low-power consuming images to be displayed on one of the plurality of display areas;

a plurality of data transfer paths for separately transferring data from each of said display data processing sections to said display section;

a plurality of display data paths for selectively transferring said display data to said plurality of display data processing sections, and display data path selecting means for performing a selection of said plurality of display data paths for said display data to be transferred to one of said plurality of display data processing sections respective thereof, wherein an image of the display data generated by said display data processing section is selectively displayed in the display area of said display section based on the selection signal of said control section.

* * * * *